US008217585B2

(12) United States Patent
Tsunoda

(10) Patent No.: US 8,217,585 B2
(45) Date of Patent: Jul. 10, 2012

(54) BALANCER BOARD FOR BACKLIGHT DEVICE

(75) Inventor: Seiichi Tsunoda, Kanagawa (JP)

(73) Assignee: Sony Corporation, Tokyo (JP)

( * ) Notice: Subject to any disclaimer, the term of this patent is extended or adjusted under 35 U.S.C. 154(b) by 418 days.

(21) Appl. No.: 12/537,782

(22) Filed: Aug. 7, 2009

(65) Prior Publication Data

US 2010/0039042 A1 Feb. 18, 2010

(30) Foreign Application Priority Data

Aug. 13, 2008 (JP) ..... P2008-208698

(51) Int. Cl.
*H05B 41/26* (2006.01)
*H05B 41/24* (2006.01)

(52) U.S. Cl. ..... 315/250; 345/102

(58) Field of Classification Search ..... 315/250, 315/294, 254, 255, 256, 307; 345/87, 102
See application file for complete search history.

(56) References Cited

U.S. PATENT DOCUMENTS

2005/0253536 A1 11/2005 Oyama
2008/0030283 A1* 2/2008 Ushijima ..... 333/24 R
2010/0073271 A1* 3/2010 Hwang et al. ..... 345/87

FOREIGN PATENT DOCUMENTS

JP 2004-39396 2/2004
JP 2004-335443 11/2004
JP 2004-349040 12/2004
JP 2005-353572 12/2005

* cited by examiner

*Primary Examiner* — Daniel D Chang
(74) *Attorney, Agent, or Firm* — Finnegan, Henderson, Farabow, Garrett & Dunner, L.L.P.

(57) ABSTRACT

In a balancer board for a back light device, a plurality of shunt coils configured to transfer power from an inverter to a plurality of fluorescent tubes arrayed in a line are arrayed in a line in a direction which is the same as the direction in which the fluorescent tubes are arrayed, and respective patterns formed on front and rear surfaces of the balancer board so as to supply the power from the inverter to each of the plurality of shunt coils are formed such that the pattern formed on one surface is located apart from the pattern formed on the other surface with a predetermined distance left therebetween while mutually intersecting three-dimensionally in respective planes.

3 Claims, 5 Drawing Sheets

BALANCER BOARD FOR BACKLIGHT DEVICE

BACKGROUND OF THE INVENTION

1. Field of the Invention

The present invention relates to a balancer board for a back light device.

2. Description of the Related Art

Nowadays, liquid crystal display devices using liquid crystal panels are being widely used in various industrial fields. In one of the liquid crystal display devices mentioned above, there is adopted a structure in which a backlight device is provided on the rear surface of the liquid crystal panel and the liquid crystal panel is irradiated with light from the backlight device. As the backlight devices, cold cathode fluorescent lamps (CCFLs) and hot cathode fluorescent lamps (HCFLs) are frequently used. A backlight system using an existing inverter has a configuration as shown in FIG. 5, in which current supplied from an inverter board 100 is shunted using a balancer board 200 so as to be supplied to each of fluorescent tubes having negative resistances such as cold cathode fluorescent lamps (CCFL(1) to CCFL(20)) or hot cathode fluorescent lamps (not shown). In the example shown in FIG. 5, the floating capacitance between a high voltage pattern and a low voltage pattern or Jin coils disposed on one surface of the balancer board 200 has a value different from that of the floating capacitance between a high voltage pattern and a low voltage pattern or Jin coils disposed on the other surface of the balancer board 200. That is, the floating capacitance between one input of the fluorescent tube and the ground (GND) differs from the floating capacitance between the other input of the fluorescent tube and the ground (GND). In the example shown in FIG. 5, an inverter circuit is driven to generate AC power of several kVrms and several tens of kHz. Thus, the influence of the difference between the floating capacitances of each fluorescent tube is so great that tube currents flowing through respective fluorescent tubes and open-circuit voltages which may be necessary to start respective florescent tubes become unbalanced among the fluorescent tubes. Note, in the specification, the open-circuit voltage is a voltage of a value equal to or higher than a certain fixed value which may be necessary to start a fluorescent tube (see, for example, Japanese Laid-Open Patent Publication No. 2005-353572).

SUMMARY OF THE INVENTION

As a result, the following problems occur. 1) Installation of an inverter transformer is unavoidable to increase a mean open-circuit voltage in order to adjust the open-circuit voltage to a lower value. 2) Installation of a capacitor for correction use is unavoidable to eliminate imbalance of currents (tube currents) flowing through fluorescent tubes. 3) In the case that current and voltage are to be supplied, in particular, in an opposite phase state, an imbalance is liable to occur in characteristics thereof owing to a limitation on a layout of patterns on a board. 4) It is unavoidable to increase the size of the board used in order to eliminate the difference between the floating capacities of each fluorescent tube.

The present invention has been made in view of the above mentioned circumstances. Therefore, it is desirable to provide a technique realizing downsizing of the board used and eliminating imbalance of characteristics of tube currents and open-circuit voltages.

According to an embodiment of the present invention, there is provided a balancer board for a backlight device, wherein a plurality of shunt coils configured to transfer power from an inverter to a plurality of fluorescent tubes arrayed in a line are arrayed in a line in a direction which is the same as the direction in which the fluorescent tubes are arrayed and respective patterns formed on front and rear surfaces of the balancer board so as to supply the power from the inverter to each of the plurality of shunt coils are formed such that the pattern formed on one surface is located apart from the pattern formed on the other surface with a predetermined distance left therebetween while mutually intersecting three-dimensionally in respective planes.

In the balancer board according to an embodiment of the present invention, the plurality of shunt coils configured to transfer power from the inverter to the plurality of fluorescent tubes arrayed in a line are arrayed in a line in a direction which is the same as the direction in which the fluorescent tubes are arrayed. The patterns configured to supply the power from the inverter to each of the plurality of shunt coils are disposed on the front and rear surfaces of the balancer board. The respective patterns are formed such that the pattern formed on one surface is located apart from the pattern formed on the other surface with a predetermined distance left therebetween while mutually intersecting three-dimensionally in respective planes. Thus, the floating capacitances measured at connection points between the balancer board and the fluorescent tubes are made uniform.

According to an embodiment of the present invention, even in a small-sized board, the floating capacitances of the fluorescent tubes are made uniform to eliminate imbalance of characteristics of the tube currents and the open-circuit voltages.

DESCRIPTION OF THE PREFERRED EMBODIMENTS

Figure 1:
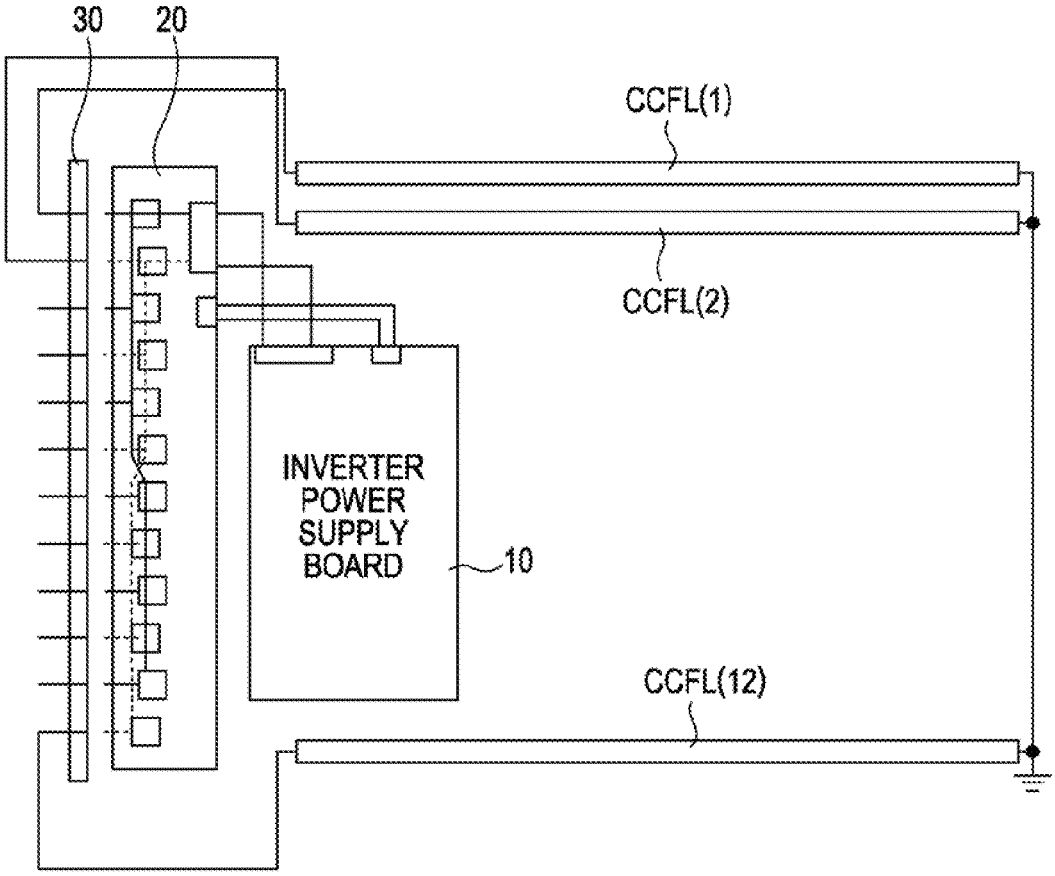
FIG. 1 is a diagram showing a backlight system according to an embodiment of the present invention.

FIG. 1 is a diagram showing a backlight system according to an embodiment of the present invention. In the backlight system according to an embodiment of the present invention, two boards, that is, an inverter power supply board (IP board) 10 and a balancer board 20 are used. Currents of equal amounts are respectively supplied to a plurality of cold cathode fluorescent lamps (CCFL(1) to CCFL(12)) via a connector 30 to make brightnesses of the lamps uniform. Incidentally, the cold cathode fluorescent lamps may be replaced with hot cathode fluorescent lamps (hereinafter, both the lamps will be referred to as fluorescent tubes). Note that the cold cathode fluorescent lamp and the hot cathode fluorescent lamp are fluorescent tubes having negative resistances. In FIG. 1, the illustration of the cold cathode fluorescent lamps CCFL(3) to CCFL(11) is omitted.

Incidentally, if voltages are applied to the plurality of fluorescent tubes in phase with the currents flowing through the fluorescent tubes, magnetic fields of the same polarity will be generated by the fluorescent tubes, which may induce noise in a liquid crystal panel (not shown) in some cases (incidentally, in the past, it has sometimes been the case that no problem has been induced depending on a driving system used for the liquid crystal panel). Thus, in the case that the fluorescent tubes are arrayed as shown in FIG. 1, the polarities of the voltages applied to the respective fluorescent tubes are alternately reversed from positive to negative or vice versa (are made out of phase with one another) tube by tube in order to reduce the adverse effect of the noise generated from the fluorescent tubes. Specifically, the currents supplied from the inverter power supply board to the balancer board are output by reversing the polarities thereof. As a result, for example, the polarity of the voltage applied to the cold cathode fluorescent lamp CCFL(1) is different from that of the voltage applied to the cold cathode fluorescent lamp CCFL(2).

In the backlight device using the above mentioned fluorescent tubes, a voltage of several Kvrms is generated. Thus, in an embodiment of the present invention, a layout of later described characteristic patterns is adopted, while maintaining a distance sufficient not to induce discharge between opposite-phase voltages by using an A surface and a B surface of the balancer board. That is, a point where a pattern on one surface to which a voltage of a certain polarity is applied intersects a pattern on the opposite surface to which a voltage of a polarity which is out of phase with the above mentioned polarity is applied is prepared. The following description will be made supposing that in FIG. 1, the front side of the drawing is defined as the A surface of the board and the rear side thereof is defined as the B surface of the board.

Figure 2:
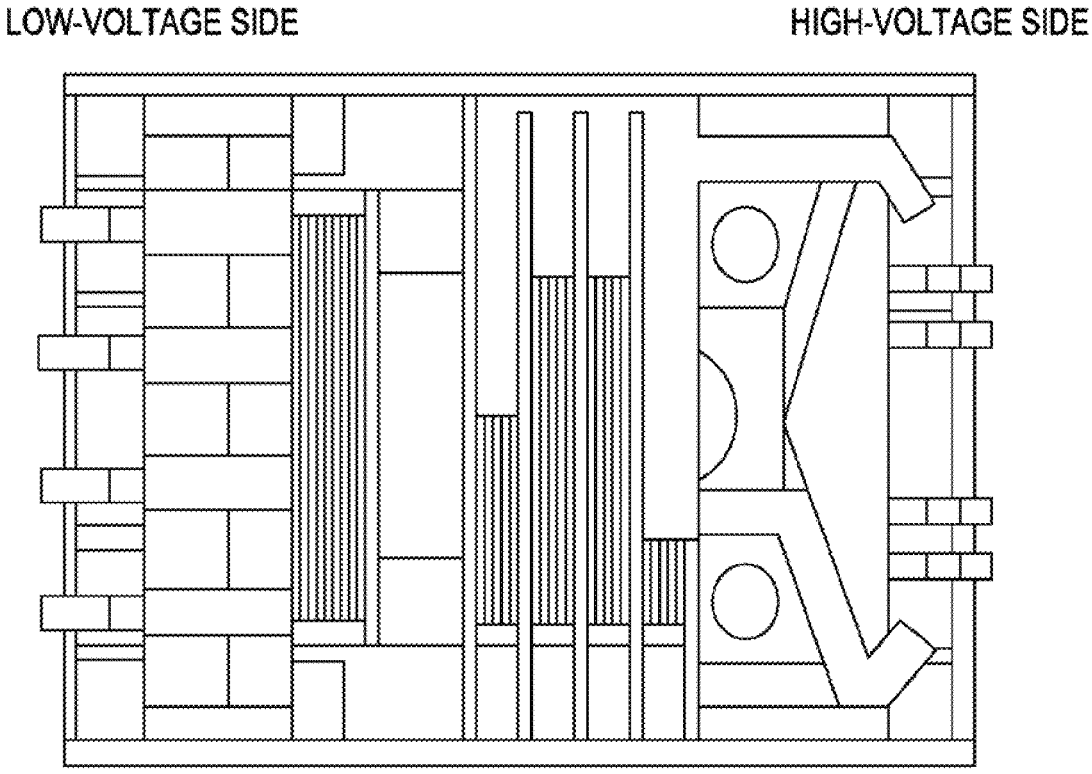
FIG. 2 is a diagram showing a shunt coil configured to shunt current according to an embodiment of the present invention.

FIG. 2 is a diagram showing a shunt coil configured to shunt current. As shown in FIG. 2, the shunt coil has a high-voltage side of a voltage of several KVrms shown on the right side of the drawing and a feedback side (a low-voltage side) shown on the left side thereof.

In the example shown in FIG. 2, in the case that the pattern which has been arranged on one surface of the board, to which a voltage of a polarity is applied intersects the pattern on the other surface to which a voltage of the opposite polarity is applied for the sake of convenience of the layout of the patterns on the board, such a problem may occur that an out-of-phase voltage is applied across the thickness of the board thereby increasing corona discharge and leakage current. Therefore, in general, there is used a layout of patterns formed such that a pattern connected to the low-voltage sides of the shunt coils intersects a pattern connected to the high-voltage sides thereof to halve the voltage applied across the board.

Figure 5:
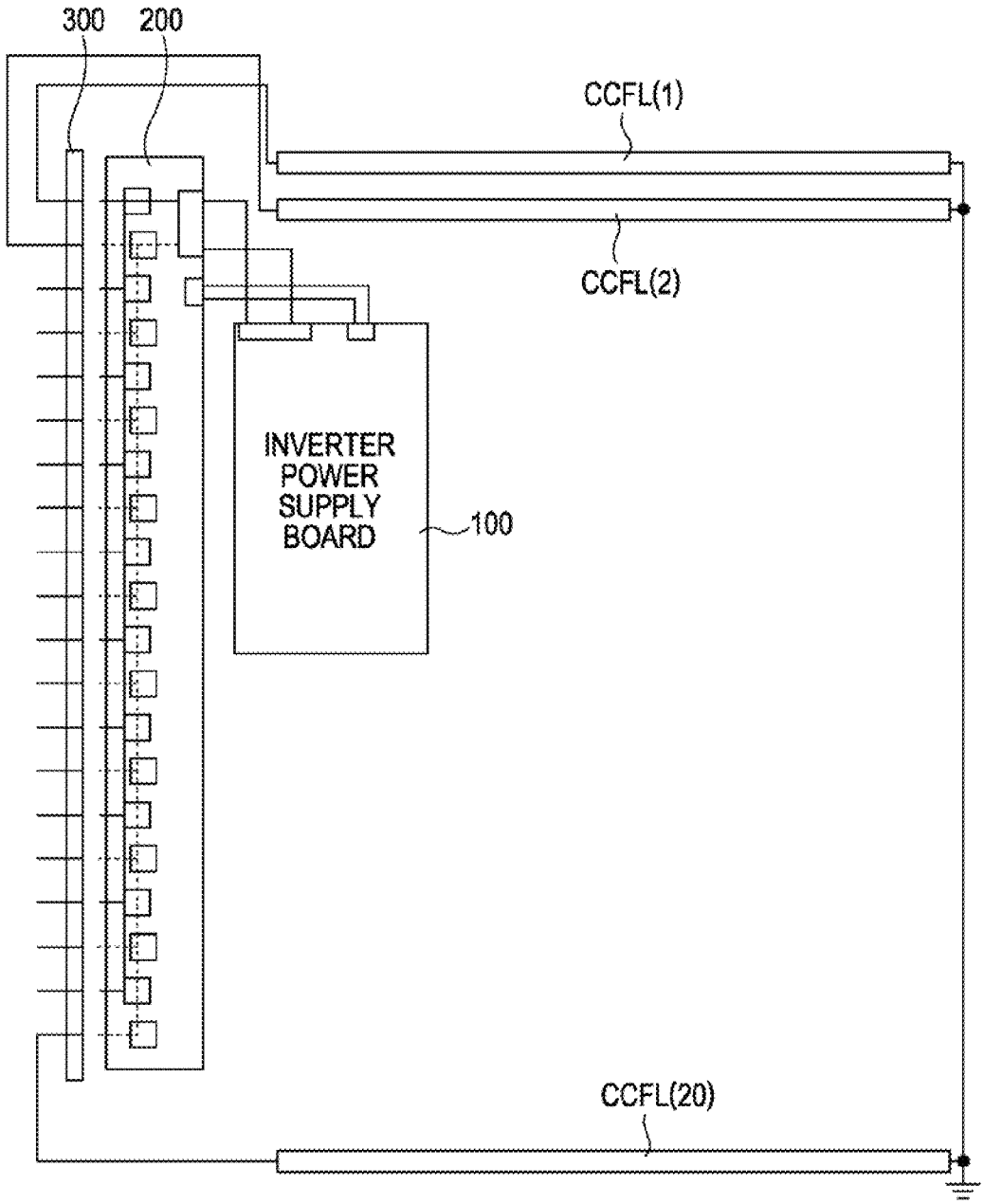
FIG. 5 is a diagram showing an existing backlight system.

Incidentally, in the case that there is no limitation on the area of the board and a board having an area of a freely set size may be used, it may be possible to freely arrange the pattern, instead of adopting the above mentioned layout of the patterns. However, in this case, the area of the board is increased and the cost of the board is increased accordingly, so that it may be unfavorable to arrange the pattern (wiring) over such a wide area. In reality, as a layout of patterns formed by taking the corona discharge, the leakage current and the area of the board into consideration, there is obtained a layout of patterns, for example, as shown in FIG. 5, in which there appear a plurality of points where the high-voltage pattern formed on one surface intersects the low-voltage pattern or the shunt coils on the surface opposite to the above mentioned surface.

When a board is prepared on the basis of the layout as mentioned above, due to the floating capacitance generated between the pattern only on one high-voltage-input side and the shunt coil, the impedance obtained at a certain polarity becomes different from that obtained at the opposite polarity. For example, the capacity (impedance) differs depending on coupling of the high-voltage pattern on the rear surface to the pattern on the surface opposite thereto or the shunt coil. As can be seen from the board layout shown in FIG. 5, the more the number of fluorescent tubes is increased, the more the difference in floating capacitance generated on the board is increased. For example, as a result of measurement of the difference in floating capacitance generated in the above mentioned case at a measurement frequency of about 1 kHz, the difference in floating capacitance has amounted to as large as several tens of pF between a value measured between one input and the ground (GND) and a value measured between the other input and the ground (GND). It has been found that due to the floating capacitance difference amounting to as large as several tens of pF which has been generated as mentioned above, an imbalance is induced in characteristics such as the characteristics of tube current flowing through the fluorescent tube and the starting voltage which may be necessary to start the fluorescent tube in an inverter and a backlight device driven at such a high voltage as several tens of kHz.

Figure 3:
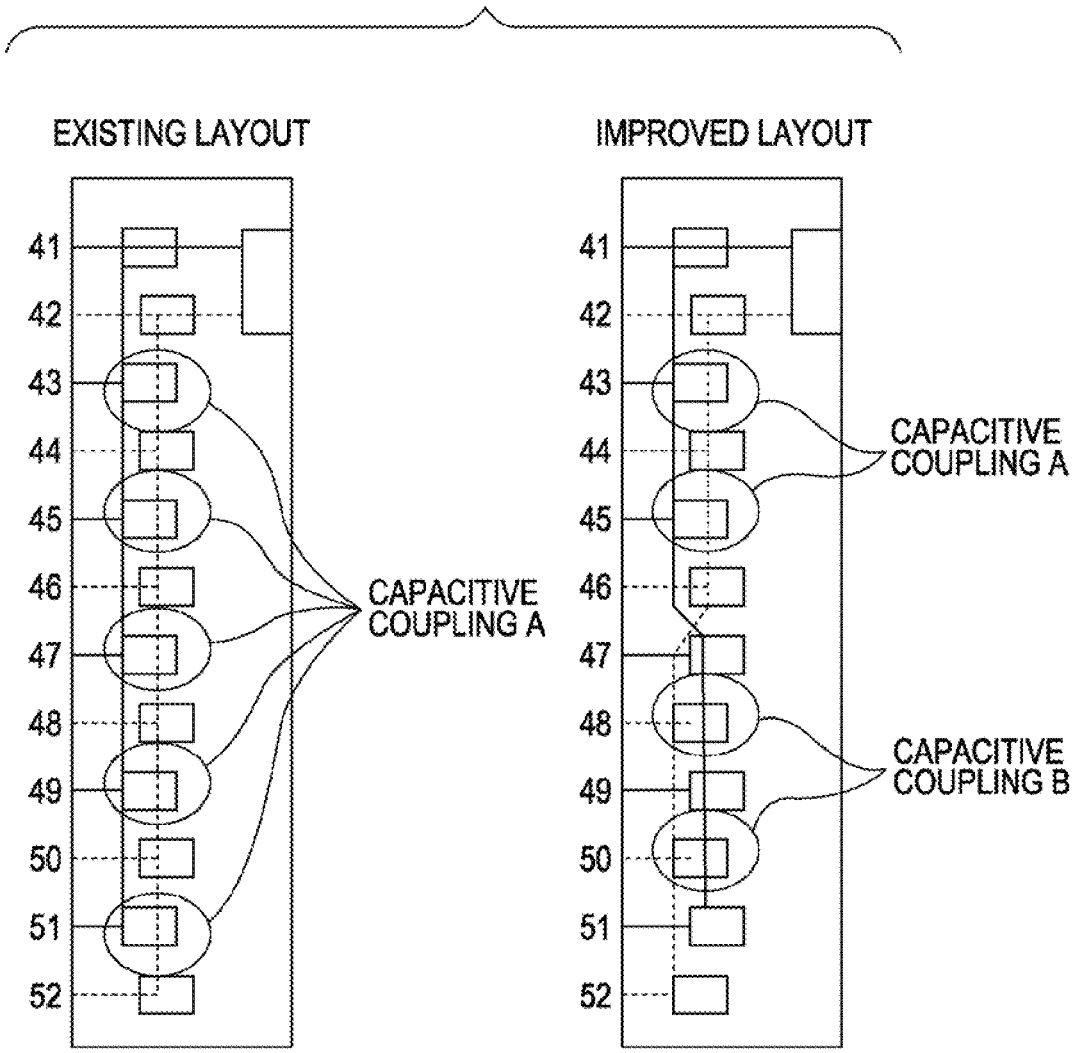
FIG. 3 is a diagram showing a layout of patterns of a balancer board according to an embodiment of the present invention as compared with a layout of patterns of an existing balancer board.

FIG. 3 shows diagrams illustrating a layout of patterns of the balancer board 20 according to an embodiment of the present invention as compared with a layout of patterns of the existing balancer board 200. Next, the features of the balancer board 20 according to an embodiment of the present invention will be described with reference to FIG. 3. Note that although in the existing backlight device shown in FIG. 5, twenty fluorescent tubes are used, the description will be made in FIG. 3 in relation to an existing example using twelve fluorescent tubes as in the case of an example according to an embodiment of the present invention in order to compare the concepts of the examples with each other.

In FIG. 3, a "Layout" for which a measure has been taken or an improved "Layout" (hereinafter, referred to as an improved "Layout") shown on the right side is the layout of the patterns according to an embodiment of the present invention. In the layout of the patterns according to an embodiment of the present invention, unlike an existing "Layout" shown on the left side, the patterns intersect at a point (between shunt coils 46 and 47) on the board to eliminate the problem of the difference in floating capacitance which would otherwise lean toward one polarity. As a result of measurement of the difference between one floating capacitance and the other floating capacitance obtained on the board having the improved layout of the patterns, the difference has been reduced to several pF showing that the imbalance has been eliminated. In FIG. 3, a solid-line part indicates the pattern on the A surface of the board and a broken-line part indicates the pattern on the B surface of the board. A capacitive coupling A has a coupled capacity of the broken-line pattern and a coil (Coil) and a capacitive coupling B has a coupled capacity of the solid-line pattern and a coil (Coil).

In the improved "Layout" according to an embodiment of the present invention shown on the right side and the existing "Layout" shown on the left side in FIG. 3, the coils respectively connected to the solid-line pattern and to the broken-line pattern extending downward in the drawing are arrayed on the front surface of the board. In the case that the coils are arrayed on the front surface of the board as in the case of the example shown in FIG. 3, the improved "Layout" according to an embodiment of the present invention is configured such that the patterns cross (intersect) at the center in order to make the coupled capacities uniform. A jumper connector is used to make the patterns cross.

In the layout of the patterns according to an embodiment of the present invention shown in FIG. 3, respective elements are disposed on the surface of the board as follows. First, a plurality of shunt coils (shunt coils 41 to 52) configured to transfer the power from the inverter to a plurality of fluorescent tubes are arrayed in a line in a direction which is the same as the direction in which the fluorescent tubes are arrayed. Patterns configured to supply the power from the inverter to each of the plurality of shunt coils are formed on the front and rear surfaces of the board. The pattern on the front surface is not in direct contact with the pattern on the rear surface and the patterns are formed on the front and rear surfaces in their respective planes apart from each other with a predetermined distance left therebetween. In addition, an intersecting point where the pattern on the front surface of the balancer board three-dimensionally intersects the pattern on the rear surface thereof is prepared.

As can be seen from FIG. 3, the fluorescent tube CCFL(1) is driven via the shunt coil 41 and the pattern for the odd-numbered coils starting from the shunt coil 41 is formed on the A surface of the board. On the other hand, the fluorescent tube CCFL(2) is driven via the shunt coil 42 and the pattern for the even-numbered coils starting from the shunt coil 42 is formed on the B surface of the board. The polarity of the voltage applied to the fluorescent tube CCFL(1) is opposite to that of the voltage applied to the fluorescent tube CCFL(2).

In the above mentioned manner, the odd-numbered shunt coils (43, 45, 47, 49 and 51) are connected to the odd-numbered fluorescent tubes, that is, the third, fifth, seventh and eleventh fluorescent tubes via the pattern formed on the A surface of the board. The polarity of voltages applied thereto is the same as that of the fluorescent tube CCFL(1). Note that the order of fluorescent tubes is enumerated starting from the uppermost fluorescent tube CCFL(1) enumerated as the first tube.

Likewise, the even-numbered shunt coils (44, 46, 48, 50 and 52) are respectively connected to the even-numbered fluorescent tubes, that is, the fourth, sixth, eighth, tenth and twelfth fluorescent tubes via the pattern formed on the B surface of the board where the uppermost fluorescent tube CCFL(1) is enumerated as the first tube. The polarity of voltages applied thereto is the same as that of the fluorescent tube CCFL(2).

How the currents flowing through the fluorescent tubes change has been actually measured using the balancer board 20 having the layout of the patterns according to an embodiment of the present invention and the balancer board 200 having the layout of the existing board patterns shown in FIG. 3.

Table 1 shows variations in the currents flowing through fluorescent tubes on the balancer board 20 having the improved "Layout" (the layout of the patterns according to an embodiment of the present invention) and the balancer board 200 having the existing "Layout" (the layout of the existing patterns) in comparison with each other. In Table 1, T101 of the existing "Layout" denotes the first fluorescent tube and T120 denotes the twentieth fluorescent tube, and 1 of the improved "Layout" denotes the first fluorescent tube and 12 denotes the twelfth fluorescent tube.

TABLE 1

| Existing layout | | Improved Layout | |
|---|---|---|---|
| No | Current | No | Current |
| T120 | 8.80 | 1 | 12.02 |
| T119 | 8.29 | 2 | 12.11 |
| T118 | 8.74 | 3 | 12.06 |
| T117 | 8.38 | 4 | 12.13 |
| T116 | 8.87 | 5 | 12.05 |

TABLE 1-continued

| Existing layout | | Improved Layout | |
|---|---|---|---|
| No | Current | No | Current |
| T115 | 8.15 | 6 | 12.13 |
| T114 | 8.64 | 7 | 12.07 |
| T113 | 8.23 | 8 | 12.11 |
| T112 | 8.77 | 9 | 12.06 |
| T111 | 8.00 | 10 | 12.16 |
| T110 | 8.80 | 11 | 12.03 |
| T109 | 7.95 | 12 | 12.17 |
| T108 | 7.54 | 13 | 12.02 |
| T107 | 8.15 | 14 | 12.11 |
| T106 | 8.68 | 15 | 12.07 |
| T105 | 8.18 | 16 | 12.18 |
| T104 | 8.04 | Mean Value of Odd Parts | 12.04 |
| T103 | 8.03 | | |
| T102 | 8.64 | Mean Value of Even Parts | 12.13 |
| T101 | 8.01 | | |
| Mean Value of Odd Parts | 8.55 | Difference | (0.09) |
| Mean Value of Even Parts | 8.14 | | |
| Difference | 0.415 | | |

As shown in Table 1, on the balancer board 200 having the existing "Layout", the difference between mean values of the currents flowing through the tubes (the odd-numbered fluorescent tubes) on one side and flowing through the tubes (the even-numbered fluorescent tubes) on the other side is about 0.4 mA. On the other hand, as a result of measurement of the difference performed in the same manner as the above on the balancer board 20 having the layout of the board patterns according to an embodiment of the present invention, the difference is reduced to 0.09 mA. The reduction in difference between the mean values of the currents (the tube currents) through the fluorescent tubes is brought about by the reduction in difference between the floating capacitances measured as mentioned above.

Table 2 shows data for actually measured open-circuit voltages obtained using a board prepared on the basis of the layout of the board patterns according to an embodiment of the present invention and a board prepared on the basis of the layout of the existing board patterns. For the data shown in Table 2, the sixteen fluorescent tubes have been formed on each board for comparison.

TABLE 2

| Existing Layout | | Improved Layout | |
|---|---|---|---|
| LAMP | Vmax (KV) | LAMP | Vmax (KV) |
| Lamp1 (HV2) | 2.333 | Lamp1 (HV2) | 2.29 |
| Lamp2 (HV1) | 2.833 | Lamp2 (HV1) | 1.96 |
| Lamp3 (HV2) | 2.375 | Lamp3 (HV2) | 2.25 |
| Lamp4 (HV1) | 3.083 | Lamp4 (HV1) | 2.04 |
| Lamp5 (HV2) | 2.375 | Lamp5 (HV2) | 2.29 |
| Lamp6 (HV1) | 2.916 | Lamp6 (HV1) | 2.08 |
| Lamp7 (HV2) | 2.375 | Lamp7 (HV2) | 2.25 |
| Lamp8 (HV1) | 3.041 | Lamp8 (HV1) | 2.08 |
| Lamp9 (HV2) | 2.791 | Lamp9 (HV2) | 2.42 |
| Lamp10 (HV1) | 2.583 | Lamp10 (HV1) | 2.29 |
| Lamp11 (HV2) | 2.458 | Lamp11 (HV2) | 2.54 |
| Lamp12 (HV1) | 2.583 | Lamp12 (HV1) | 2.21 |
| Lamp13 (HV2) | 2.458 | Lamp13 (HV2) | 2.29 |
| Lamp14 (HV1) | 2.666 | Lamp14 (HV1) | 2.38 |
| Lamp15 (HV2) | 2.791 | Lamp15 (HV2) | 2.21 |
| Lamp16 (HV1) | 2.625 | Lamp16 (HV1) | 2.29 |
| Mean Value of Odd Parts | 2.495 | Mean Value of Odd Parts | 2.32 |
| Mean Value of Even Parts | 2.791 | Mean Value of Even Parts | 2.17 |

TABLE 2-continued

| Existing Layout | | Improved Layout | |
|---|---|---|---|
| LAMP | Vmax (KV) | LAMP | Vmax (KV) |
| Total Mean Value | 2.643 | Total Mean Value | 2.24 |

The data in Table 2 indicates that, on the balancer board having the layout (the existing Layout) of the existing board patterns, the difference between mean values of the open-circuit voltages applied to the tubes (the odd-numbered fluorescent tubes) on one side and applied to the tubes (the even-numbered fluorescent tubes) on the other side is as large as about 300V(0-p). On the other hand, on the balancer board having the layout (the improved Layout) of the patterns according to an embodiment of the present invention, the difference between mean values of the open-circuit voltages applied to the tubes (the odd-numbered fluorescent tubes) on one side and applied to the tubes (the even-numbered fluorescent tubes) on the other side is reduced to as small as 150V(0-p). That is, it can be seen that the reduction in difference between the floating capacitances leads to the reduction in difference between the mean open-circuit voltage values.

The layout of the patterns according to an embodiment of the present invention has features as follows. The patterns configured to supply the power from the inverter power supply board to the shunt coils are formed on two surfaces, that is, the front and rear surfaces of the board. The shunt coils are arrayed almost in a line in a direction in which the fluorescent tubes are arrayed. The difference between floating capacitances of driven electrodes of the fluorescent tubes is reduced by making the patterns configured to supply the power from the inverter power supply board to the shunt coils intersect three-dimensionally at a certain point on the board. The pattern-intersecting point is a position where the coupled capacities of inputs equal to each other or the difference between floating capacitances is minimized. In an embodiment of the present invention, the pattern-intersecting point is defined as an intermediate part in a shunt-coil-arrayed direction. However, the pattern-intersecting point is not typically limited to the intermediate part. The same effect may be obtained by reducing the difference between floating capacitances. An imbalance induced in the current characteristics and open-circuit voltage characteristics of the fluorescent tubes may be reduced by making the impedance of the pattern on the front surface of the board coincide with the impedance of the pattern on the rear surface of the board in the above mentioned manner. In addition, downsizing of the board may be attained accordingly.

Next, a modified embodiment of an embodiment of the present invention will be described.

Figure 4:
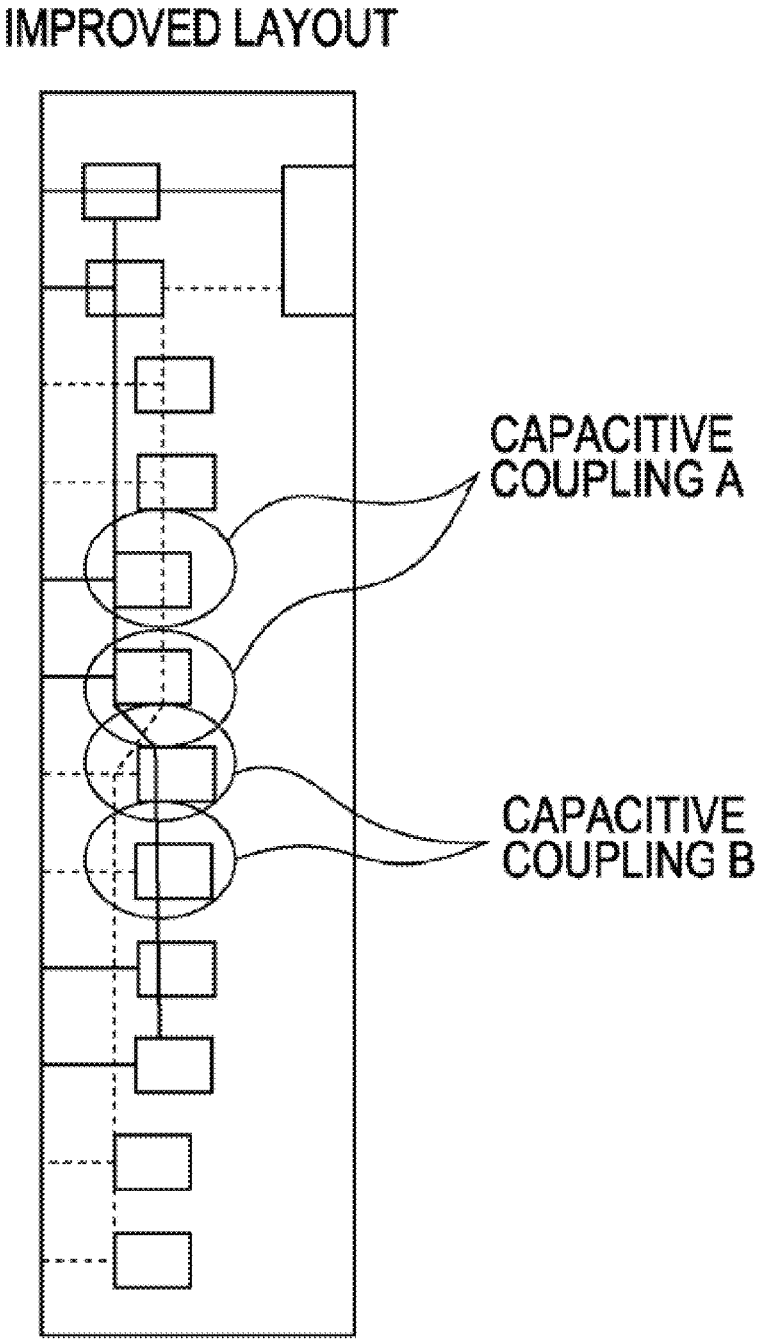
FIG. 4 is a diagram showing a modified embodiment of an embodiment of the present invention.

FIG. 4 is a diagram showing a modified embodiment of an embodiment of the present invention. In the modified embodiment shown in FIG. 4, the polarities of each two fluorescent tubes are reversed in the order of the positive polarity, the positive polarity, the negative polarity and the negative polarity, instead of alternately reversing the polarities. The same effect as the above may be also obtained by using the layout of the patterns shown in FIG. 4.

In the above mentioned embodiments of the present invention, the description has been made on condition the polarities of the voltages input into the fluorescent tubes are reversed one tube at a time and two tubes at a time. However, even though the voltages applied to the fluorescent tubes are at the same polarity, the effect of reducing the imbalance induced in the current characteristics and the open-circuit voltage characteristic of the fluorescent tubes may be obtained by adopting the layout of the patterns according to an embodiment of the present invention.

The backlight device shown in FIG. 1 is of the one-side-driven type (one electrode is grounded (GND)). However, even in a device of the type that the both electrodes are driven (the both sides are at high voltages), the effect of reducing the imbalance induced in the current characteristics and the open-circuit voltage characteristics of the fluorescent tubes may be attained by adopting the layout of the patterns according to an embodiment of the present invention.

In the backlight device shown in FIG. 1, the description has been made using a shunt coil of the type which is at a high voltage on one side and at a low voltage on the other side. However, the layout of the patterns according to an embodiment of the present invention exhibits the effect even in the case that a shunt coil of the type that high voltages are generated on both sides thereof or of the type that the both sides are at the same potential is used, or semiconductors and capacitors are laid out like shunt coils. That is, the effect of reducing the imbalance induced in the current characteristics and the open-circuit voltage characteristics of the fluorescent tubes may be attained by adopting the layout of the patterns according to an embodiment of the present invention.

In the above mentioned embodiments, the description has been made on condition that the inverter power supply board is separated from the balancer board. However, even though the inverter board is integrated with the balancer board, the effect of reducing the imbalance induced in the current characteristics and the open-circuit voltage characteristics of the fluorescent tubes may be also attained by adopting the layout of the patterns according to an embodiment of the present invention.

The present application contains subject matter related to that disclosed in Japanese Priority Patent Application JP 2008-208698 filed in the Japan Patent Office on Aug. 13, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A balancer board for a backlight device, comprising:

a plurality of shunt coils configured to transfer power from an inverter to a plurality of fluorescent tubes arrayed along a first direction, the shunt coils being arrayed along the first direction;

a first pattern formed on a front surface of the balancer board and configured to supply power from the inverter to at least a first one of the shunt coils; and a second pattern formed on a rear surface of the balancer board and configured to supply power from the inverter to at least a second one of the shunt coils, wherein the first pattern is located apart from the second pattern with a predetermined distance along a second direction different from the first direction, and wherein the first and second patterns intersect with each other three-dimensionally in respective planes.

2. The balancer board according to claim 1, wherein every other shunt coil is connected to different patterns.

3. The balancer board according to claim 1, wherein the every other two shunt coils are connected to different patterns.

* * * * *